United States Patent [19]

Dorer et al.

[11] 4,354,674

[45] Oct. 19, 1982

[54] DEVICE FOR DISTRIBUTING FLEXIBLE SHEETS IN COLLECTING BINS

[75] Inventors: Wilfried Dorer, Donaueschingen; Manfred Fuss, St. Georgen; Werner Lehmann, Gutach, all of Fed. Rep. of Germany

[73] Assignee: Mathias Bäuerle GmbH, Fed. Rep. of Germany

[21] Appl. No.: 198,820

[22] Filed: Oct. 20, 1980

[30] Foreign Application Priority Data

Nov. 10, 1979 [DE] Fed. Rep. of Germany ..... 2945502

[51] Int. Cl.[3] ..... B65H 39/115; B65H 29/52

[52] U.S. Cl. ..... 271/296; 271/287; 271/207

[58] Field of Search ..... 271/296, 297, 287, 279, 271/294, 208, 278, 302, 207; 270/58

[56] References Cited

U.S. PATENT DOCUMENTS 3,685,819 8/1972 Deutsch ..... 271/296 X 3,998,450 12/1976 Howard ..... 271/296 X

FOREIGN PATENT DOCUMENTS 2631847 1/1978 Fed. Rep. of Germany ..... 271/208

OTHER PUBLICATIONS

Baumann, G. W. et al., "Collator Bin Wall," *IBM Technical Disclosure Bulletin*, vol. 19, No. 12, May, 1977. pp. 4494–4495.

*Primary Examiner*—Bruce H. Stoner, Jr.

*Attorney, Agent, or Firm*—McGlew and Tuttle

[57] ABSTRACT

A device for distributing sheets in a predetermined sequence into a plurality of collecting pockets successively arranged in a horizontal sheet feed path includes a guide member connected at the upper end of each of a plurality of walls successively arranged beneath the feed path to define the collecting pockets. The guide member extends at a substantially equal angle of inclination relative to the feed path and a deflection plane through which the sheets are deflected. A guide tongue connected to the guide plate extends in the same plane of inclination of the guide plate and projects into an adjacent one of the collecting pockets. A guide fin, connected to the guide plate, is provided for preventing areal contact between a deflected sheet and a guide plate.

8 Claims, 5 Drawing Figures

DEVICE FOR DISTRIBUTING FLEXIBLE SHEETS IN COLLECTING BINS

FIELD AND BACKGROUND OF THE INVENTION

The invention relates, in general, to a device for distributing flexible sheets, particularly paper sheets, in a plurality of collecting bins, and, more particularly, to a device for distributing flexible sheets to collecting bins arranged in rows side by side underneath a horizontal sheet pass-through track, which is composed of inclined wall plates, where sheet guide belts and a sheet deflector, including at least one pair of deviation rollers and moving step by step from collecting bin to collecting bin, are arranged in the sheet pass-through track, this sheet deflector steering the individual sheets successively from the horizontal sheet pass-through track through an at least substantially vertical deflection plane into the individual bins.

U.S. Pat. No. 3,685,819 discloses a device of the above mentioned type in which two guide rollers are rotatably mounted at a horizontal spaced distance from each other in a deflecting truck, movable in steps, along the sheet pass-through track, between which is arranged a sheet deflector consisting of a flat baffle plate and lockable in two different pivotal positions. In one pivotal position of the sheet deflector, the incoming sheets are steered into one of the collecting bins, while in the other pivotal position a bridge is formed between guide rollers, over the guide rollers in the deflecting truck runs an endless belt which is guided in different planes in a rectangular course by means of correspondingly arranged guide rollers around the collecting bin arrangement. The stepwise movement of the deflecting truck from collecting bin to collecting bin is effected by a special control of the belt drive by means of an electromagnetic locking mechanism to block one of the guide rollers. In addition, electrically controllable mechanical locking means are provided to control the stepwise movement of the deflecting truck. The individual collecting bins arranged in rows side by side underneath the sheet pass-through track, consist of inclined flat wall plates which have no paper guide elements. Due to the absence of special paper guide elements in the vicinity of the openings of the individual collecting bins on the inlet side, it is necessary to arrange the individual wall plates in a relatively great horizontal distance from each other so that an inlet opening is formed into which the paper sheets can be introduced.

In another known device for distributing paper sheets, disclosed in West German Offenlegungsschrift No. 20 48 981, a sheet deflector in the form of a rotatably mounted double wedge is arranged at the end of a horizontal pass-through track, which is formed by the contiguous strands of two superposed conveyor belt systems, and which can be adjusted in three different positions. Underneath this sheet deflector switch arrangement, a second vertically extending belt system is arranged which is guided by a deflecting truck moving, in steps, in a vertical plane along inlet openings of superposed collecting bins. There are again two groups of these vertically extending conveyor belts. One group of these vertical conveyor belts is guided over fixed rollers in a frame and runs over guide rollers superposed practically vertically in the truck, which effect a horizontal deflection. Another group of the vertical drive belts runs over the upper roller of the deflecting truck, as well as over stationary guide rollers arranged above the conveyor zone of the truck and over a tension roller moving in the horizontal plane of the guide rollers which is secured on a tackle connected to a chain drive of the deflecting truck. In this known arrangement, the ends of the plates forming the collecting bins at the inlet are inclined plates not equipped with special paper guide elements, so their intervals must also be relative great to ensure a proper paper feed. Great distances between the individual wall plates of the collecting bins require, however, much space and a small number of collecting bins within a certain length of the pass-through track.

British Pat. No. 1 278 396 discloses another device for distributing paper sheets in collecting bins provided with a vertical pass-through track which is formed by several vertical conveyor belts and a number of vertically superposed guide rollers. The individual collecting bins, which are made of plates arranged in horizontal planes, are vertically superposed. The intervals of the various plates forming the collecting bins are equal to the center distances of the individual vertically superposed guide rollers. As a sheet deflector is provided a two-arm yoke which is pivotally mounted on a carriage moving step by step along the sheet pass-through track, and which has two fingers which protrude into the sheet track and which have deflecting surfaces to steer the incoming sheets between two guide rollers each. In these vertically superposed collecting bins, the plates are provided with extensions extending like fingers between the guide rollers arranged on a common shaft, which serve as paper guide elements. Nevertheless, the distance between the individual plates must also be selected here relatively large to ensure the feed of the paper sheet into the individual collecting bins.

In another embodiment, where the collecting bins are arranged horizontally side by side and the sheet pass-through track horizontally, the individual collecting bins which are each assigned to a pair of guide rollers, consist of flat wall plates which have no paper guide elements. The result is that the paper guide elements provided on the plates of the vertically superposed collecting bins are only considered necessary in a horizontal feed into the individual collecting bins. A common feature of all these known devices for distributing paper sheets into collecting bins is that the intervals of the walls or plates forming the collecting bins are substantially greater than would be necessary for the regularly occurring maximum thicknesses of the paper stacks to be collected in the individual collecting bins. In one known device, this space-consuming drawback is due to the lack of suitable paper guide elements in the range of the pocket openings at the inlet, and in the other known devices to the fact that the arrangement of the collecting bins must be adapted to the center distances of the guide rollers assigned in pairs to each collecting bin.

SUMMARY OF THE INVENTION

The invention is based on the problem of improving a device of the above-mentioned type in such a way that a satisfactory guidance of the sheets is ensured both in the range of the inlet openings and in the collecting bins themselves, even with relatively narrow inlet openings and small intervals of the wall plates of the collecting bins, which allow a greater number of collecting bins with little space requirement.

This problem is solved according to the invention in this way that the individual wall plates of the collecting bins are each provided at their upper ends on the inlet side with a guide element forming the same angle of inclination with the sheet pass-through track and deflection plane of the sheet deflector, which extends obliquely to the upper wall plate section and intersects the respective deflection plane.

The main advantage of this arrangement is that the sheets entering the various collecting bins never come in areal contact with the wall plates forming the collecting bins during their entire feeding movement, but that there is only a punctiform or linear contact between the entering sheets and the guide elements, so that the sheets can never stick, even when they are charged with static electricity. Beyond that, the feed track of the flexible sheets can be determined almost exactly in such a way that the leading transverse edge of the individual sheets within a collecting bin is always guided on smooth guide surfaces or lines until it arrives on the bottom of the respective collecting bin. In order to be able to produce the guide elements, the guide tongues or guide fingers and the guide fins properly with low production methods, the guide elements consist according to another feature of the invention at the upper ends of the wall plates of bent-off plate sections, the guide tongues or guide fingers of wall plate sections cut free below the bending edge, and the guide fins of corrugation extending in a right angle to the bending edge.

It is of advantage if the guide tongue or guide fingers are arranged between two guide fins so that a uniform guidance of the edge is ensured over the entire width of the sheet.

If the guide tongues or guide fingers are provided at their ends protruding into the collecting bins with pointed teeth, it is possible to shunt off the static electricity by the known point effect by which static electricity can be best shunted off.

Another improvement of the guidance of the sheets in the inlet range of the collecting bins can be achieved by arranging on the sheet deflector underneath the gap of the pairs of deflection rollers a baffle which forms with the tangential guiding direction of the guide gap a smaller acute angle than with the guide elements of a wall plate which is in the deflection position of the sheet deflector under the guide gap of the pair of deflection rollers.

Accordingly, it is an object of the invention to provide an improved device for distributing flexible sheets, particularly paper sheets, into a plurality of collecting pockets successively arranged beneath a horizontal sheet feed path, of the type having a plurality of walls substantially and vertically disposed and successively arranged beneath the feed path. The device is of the type in which adjacent ones of the walls have an area therebetween defining one of collecting pockets and means are provided for moving the sheets through the feed path in steps from collecting pocket to collecting pocket and for successively displacing individual ones of the sheets through a substantially vertical deflection plane into a collecting pocket. The improvement in accordance with the invention includes a guide plate connected at the upper end of each of the walls extending at a substantially equal angle of inclination relative to the feed path and the deflection plane and at an oblique angle relative to the upper portion of the respective wall connected thereto. A guide tongue is provided connected to the guide plate extending in the same plane of inclination of the guide plate and projecting into an adjacent one of the collecting pockets. Further, guide fin means are connected to the guide plate for preventing areal contact between the sheet and the guide plate. In accordance with a preferred embodiment of the invention, the guide plate is an integral upper end portion of each of the walls. Each of the walls preferably has a bending edge above which the guide plate obliquely extends. Moreover, the guide tongue preferably is an integral portion of each of the walls beneath the bending edge and each of the walls has an aperture extending therethrough partly separating the guide tongue from the wall. In accordance with another preferred feature of the invention, the guide fin means includes a corrugation in each of the walls extending at a right angle relative to the bending edge. The guide fin means preferably includes a plurality of guide fins and the guide tongue is preferably mounted intermediate adjacent guide fins. In addition, the guide tongue preferably includes a serrated edge at the end projecting into an adjacent one of the collecting pockets.

In accordance with still a further preferred feature of the invention, a baffle is provided between the feed path and the collecting pockets extending through the deflection plane and at an angle smaller than the angle between the guide plate and deflection plane.

It is a further object of the invention to provide an improved device for distributing flexible sheets, particularly paper sheets, into a plurality of collecting pockets successively arranged beneath a horizontal sheet feed path which is simple in design, rugged in construction and economical to manufacture.

The various features of novelty which characterize the invention are pointed out with particularly in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION

Figure 1:
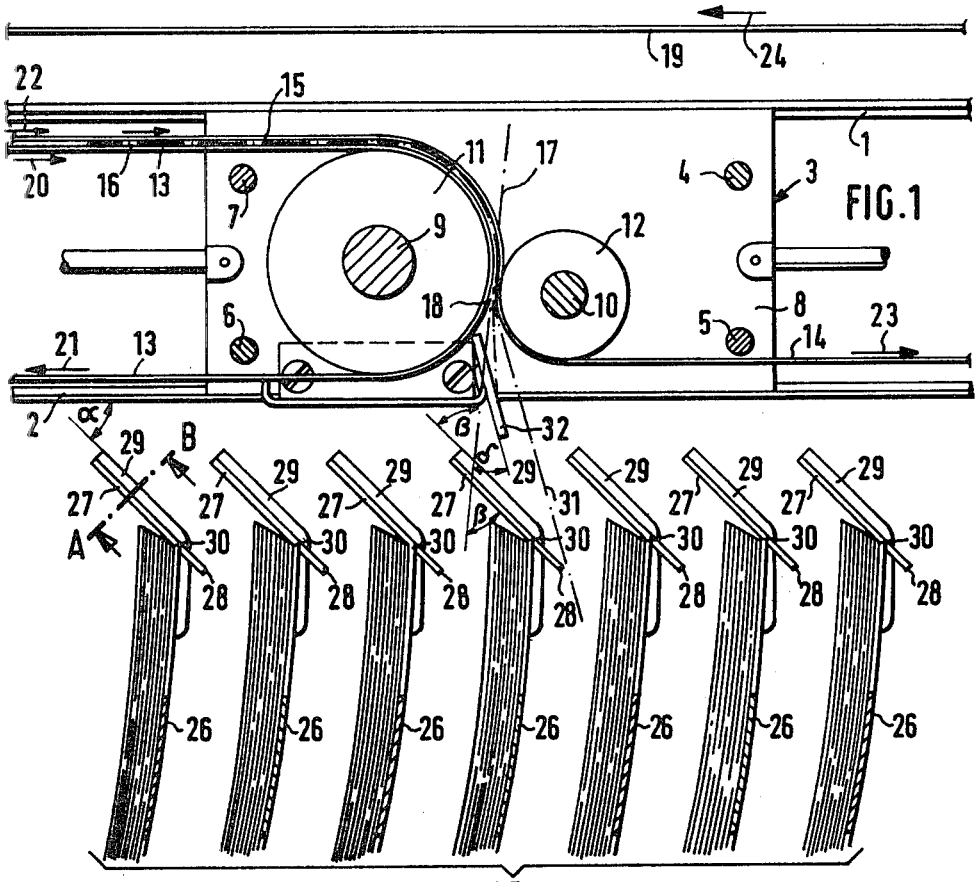
FIG. 1 schematically illustrates a side elevational view of a sheet deflector movable, step by step, along a horizontal pass-through track with a number of collecting bins arranged underneath.
Figure 2:
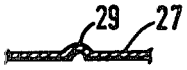
FIG. 2 illustrates a cross section through a guide fin of the guide elements of wall plate of a collecting bin taken along view line A–B in FIG. 1.

In a frame (not shown) a carriage 3 is guided in lateral horizontal guide rails 1 and 2. Carriage 3 is composed of two slabs 8 (only one of which is shown) which are joined with each other by posts 4,5,6 and 7. Shafts 9 and 10 are mounted horizontally in slabs 8 in transverse relationship relative to guide rails 1 and 2. A plurality of rollers 11, 12 are mounted on each of the shafts 9,10. Rollers 11 have twice the diameter of rollers 12. Over rollers 11 extend endless conveyor belts 13, the strands of which extend horizontally, that is, parallel to guide rails 1 and 2. Apart from conveyor belts 13 are also provided conveyor belts 14 which are conducted both around rollers 11 and rollers 12. Conveyor belts 14 have leading strands 15 which are directly above the upper strand of conveyor belt 13 forming with the latter a horizontal feedpath composed of a sheet pass-through track 16 which terminates on the circumference of rollers 11 and passes over into a deflection track which, in turn, terminates in a substantially vertical deflection plane 17. The direction of this deflection plane 17 is determined by the common tangent of rollers 11 and 12 forming a guide gap 18 with each other, through which the paper sheets to be distributed are deflected downwardly. The two rollers 11 and 12, together with conveyor belts 14, form a sheet deflector. The conveyor sheets are conducted over stationary deviation rollers (not shown) which are arranged at the end of the path of carriage 3. The stationary deviation rollers hold the returning strands 19 of conveyor belts 14 above guide rail 1. In order to facilitate the understanding, the directions of motion of the individual strands of conveyor belts 13 are indicated by arrows 20, 21. The directions of motion of conveyor belts 14 are indicated by arrows 22, 23,24.

A number of collecting pockets or bins 25 are arranged underneath guide rails 1 and 2 of carriage 3. The collecting bins 25 includes wall plates 26. Wall plates 26 are provided at their upper end with inclined guide elements 27. The guide elements 27 form with guide rails 1 and 2, extending parallel to sheet pass-through track 16, an angle of inclination alpha ($\alpha$) with respect to the horizontal plane. The angle of inclination alpha is substantially equal to an angle beta ($\beta$) formed between guide plate 2 or elements 27 and deflection plane 17 of rollers 11 and 12 which constitute the sheet deflector. The guide elements 27 are each provided with a guide tongue 28 which protrudes into the inlet opening of the collecting bin arranged at the back of the respective wall plate 26 to which the guide element is mounted. Each guide tongue 28 has the same angle of inclination alpha and hence, extends in the same plane as its respective element 27. Guide fins 29 are arranged at both sides of guide tongues 28 on the oblique top side of guide elements 27. The guide fins 29 are formed with corrugations that extend downwardly beyond a rounded bending edge 30, so that they help to stabilize the form, particularly in the vicinity of bending edge 30. The main function of the guide fins 29 is to prevent areal contact between the entering paper sheet 31 and guide elements 27. As shown in FIG. 1, the guide elements 27 are arranged so that they intersect guide plane 17 of the two rollers 11 and 12, forming the sheet deflector, when carriage 3 is temporarily in rest position at the end of a motional step. In other words, the sequential stepwise movement of carriage 3 in the direction of arrow 23 or in the opposite direction of arrow 21 is so controlled that deflection plane 17 intersects one of the guide elements 27. Means for controlling and driving carriage 3 are well known to those skilled in the art, and therefore, require no further description.

In order to prevent paper sheets, deflected downwardly by the sheet deflector, from impinging at the intersection of deflection plane 17 on guide fins 29 of guide elements 27, a baffle 32 is arranged on carriage 3 underneath guide gap 18. The baffle 32 forms an acute angle delta ($\delta$) with deflection plane 17. The baffle ensures that the deflected sheet 31 impinges on guide fins 29 in the proximity of bending edge 30 of guide element 27 which is under guide gap 18 of the sheet deflector, and arrives, from there, over guide tongues 28 in the adjacent collecting bin.

Figure 5:
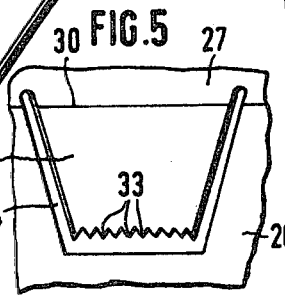
FIG. 5 shows a guide tongue having pointed teeth.

Thus, there can be no areal contact in the above-described paper guide system between the downwardly deflected sheets 31 entering a collecting bin and guide elements 27 or guide tongues 28 and guide fins 29, but at best a linear contact, which positively prevents "sticking". It is advisable, however, to provide guide tongues 28 at their ends projecting into a collecting pocket with pointed teeth 33, which define a serrated edge, as shown in FIG. 5. Pointed teeth, due to their generally known point action, are capable of shunting off static electric charges of incoming sheets when they come in contact with the latter.

Figure 4:
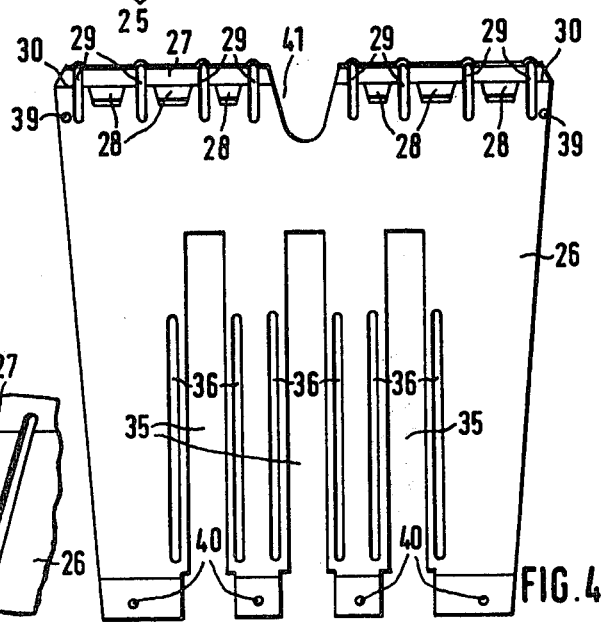
FIG. 4 illustrates a front view of the wall plate of FIG. 3.

As best shown in FIGS. 4 and 5, guide tongues 28 are an integral part of both wall plates 26 and the guide wall elements 27. Guide tongues 28 are formed by recesses 34 cut free from wall plates 26. Guide tongues 28 form thus an extension of guide elements 27 with the same angle of inclination alpha.

Figure 3:
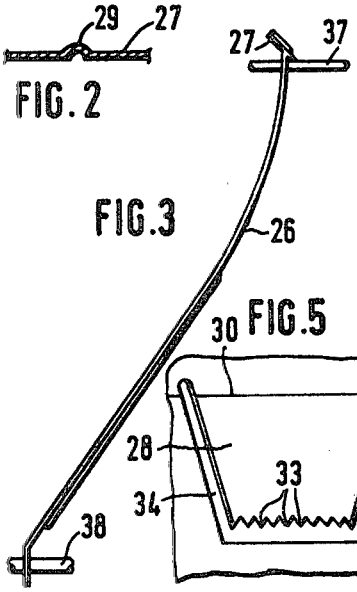
FIG. 3 shows a wall plate in a profile.

The lateral profile, represented in FIG. 3, of wall plates 26 illustrates that plates 26 are inclined and straight in the bottom part, and are directed substantially in a vertical arc up to bending edge 30. In order to reduce the weight, as shown in FIG. 4, wall plates 26 are provided with several vertical cutouts 35. Stiffening corrugations 36 are arranged adjacent to the cutouts 35 on portion of the rear side of wall plates 26. The various wall plates are secured to stationary bars 37, 38 (see FIG. 3) which extend through bores 39,40 (see FIG. 4). At their upper end, wall plates 26 have a central recess 41 for the manual engagement of the collected sheet stack.

While a specific embodiment of the invention has been shown and described in detail to illustrate the application of the principles of the invention, it will be understood that the invention may be embodied otherwise without departing from such principles.

What is claimed is:

1. An improved device for distributing flexible sheets, particularly paper sheets, into a plurality of collecting pockets successively arranged beneath a horizontal sheet feed path, of the type having a plurality of walls substantially vertically disposed and successively arranged beneath the feed path, adjacent walls having an area therebetween defining one of the collecting pockets, means for moving the sheets through the feed path and for successively displacing individual ones of the sheets through a substantially vertical deflection plane into a collecting pocket, the improvement comprising a guide plate connected at the upper end of each of the walls and extending upwardly therefrom at a substantially equal angle of inclination relative to the feed path and the deflection plane and positioned to intersect the deflection plane, and at an oblique angle relative to the upper portion of the respective wall connected thereto, a guide tongue connected to said guide plate extending in the same plane of inclination of said guide plate and projecting into an adjacent one of the collecting pockets, and guide fin means connected to said guide plate for preventing areal contact between the sheet and the guide plate, each of said walls having a bending edge above which said guide plate obliquely extends, each of said walls having an aperture extending therethrough partly separating said guide tongue from said wall, and said guide fin means comprising a corrugation in each of said walls extending at a right angle relative to said bending edge.

2. The improved device for distributing flexible sheets as set forth in claim 1 wherein said guide plate is an integral upper end portion of each of the walls, wherein said guide tongue is an integral portion of each of said walls beneath said bending edge.

3. The improved device for distributing flexible sheets as set forth in claim 2, wherein said guide fin means comprises a plurality of guide fins, and said guide tongue being mounted intermediate adjacent guide fines.

4. The improved device for distributing flexible sheets as set forth in claim 3, wherein said guide tongue includes a serrated edge at the end projecting into an adjacent one of the collecting pockets.

5. The improved device for distributing flexible sheets as set forth in claim 2, wherein said guide tongue includes a serrated edge at the end projecting into an adjacent one of the collecting pockets.

6. The improved device for distributing flexible sheets as set forth in claim 1, wherein said guide fin means comprises a plurality of guide fins, and said guide tongue being mounted intermediate adjacent guide fins.

7. The improved device for distributing flexible sheets as set forth in claim 1, wherein said guide tongue includes a serrated edge at the end projecting into an adjacent one of the collecting pockets.

8. The improved device for distributing flexible sheets as set forth in claim 1, further comprising a baffle between the feed path and the collecting pockets extending through the deflection plane at an angle smaller than the angle between said guide plate and deflection plane.

* * * * *